US010727621B1

(12) United States Patent
Senofsky et al.

(10) Patent No.: US 10,727,621 B1
(45) Date of Patent: Jul. 28, 2020

(54) ELECTRICAL CONNECTOR SYSTEM FOR LED TAPE LIGHTING

(71) Applicant: LED Inspirations, LLC, Cypress, TX (US)

(72) Inventors: Nicholas William Senofsky, Cypress, TX (US); Reed Jeffrey Holland, Tomball, TX (US); John Tyler Stenz, Cypress, TX (US)

(73) Assignee: LED INSPIRATIONS, LLC, Cypress, TX (US)

( * ) Notice: Subject to any disclaimer, the term of this patent is extended or adjusted under 35 U.S.C. 154(b) by 0 days.

(21) Appl. No.: 16/507,092

(22) Filed: Jul. 10, 2019

(51) Int. Cl.

| | |
|---|---|
| ***H01R 13/62*** | (2006.01) |
| ***H01R 12/71*** | (2011.01) |
| ***F21V 19/00*** | (2006.01) |
| ***F21S 4/24*** | (2016.01) |

(52) U.S. Cl.
CPC ..... *H01R 12/712* (2013.01); *F21S 4/24* (2016.01); *F21V 19/003* (2013.01)

(58) Field of Classification Search
CPC ..... H01R 12/712; H01R 12/79; H01R 12/88; H01R 35/04; H01R 12/77; H01R 12/774; F21V 19/003; F21S 4/24
USPC ..... 439/59, 67, 329, 493, 260, 261, 640, 31
See application file for complete search history.

(56) References Cited

U.S. PATENT DOCUMENTS 4,173,035 A * 10/1979 Hoyt ..... H05K 1/189 362/249.04
5,308,262 A * 5/1994 Chishima ..... H01R 12/592 439/495
6,634,903 B2 * 10/2003 Gunreben ..... H01R 13/5829 439/459
6,771,510 B1 * 8/2004 Novak ..... G06F 1/184 361/679.02
7,841,872 B2 11/2010 Zhang et al.
8,714,772 B1 * 5/2014 Levante ..... F21V 23/06 362/217.17

(Continued)

OTHER PUBLICATIONS

International Search Report of the International Searching Authority (USPTO) for international application PCT/US2016/029091 dated Jul. 26, 2016.

(Continued)

*Primary Examiner* — Abdullah A Riyami
*Assistant Examiner* — Nelson R. Burgos-Guntin
(74) *Attorney, Agent, or Firm* — Basil M. Angelo; Angelo IP

(57) ABSTRACT

An electrical connector system includes a cap, a printed circuit board, and a tray. The cap includes a plurality of hinge pins disposed on transverse sides of the cap, a plurality of cap mounting holes that extend through the cap, a cap light cutout portion, and a plurality of cap retention features. The printed circuit board includes a plurality of printed circuit board mounting holes, a printed circuit board light cutout portion, a plurality of printed circuit board electrical contacts, and a plurality of pogo-pins that are electrically connected to the corresponding plurality of printed circuit board electrical contacts. The tray includes a plurality of hinge pin receivers formed in transverse sidewalls of the tray, a tray mounting surface, and a plurality of tray retention features. Each hinge pin receiver includes a first portion separated from a second portion by a pin retention feature.

16 Claims, 17 Drawing Sheets

(56) References Cited

U.S. PATENT DOCUMENTS

| | | | | |
|---|---|---|---|---|
| 9,647,349 | B1 * | 5/2017 | Stillman | H01R 13/5216 |
| 9,909,743 | B2 * | 3/2018 | Dankelmann | F21V 21/005 |
| 10,107,464 | B2 * | 10/2018 | Hoffman | F21V 19/0055 |
| 10,344,954 | B1 * | 7/2019 | Tischler | F21V 23/06 |
| 10,378,747 | B1 * | 8/2019 | Hanslip | H05B 45/20 |
| 10,591,114 | B1 * | 3/2020 | Lassen | F21V 15/013 |
| 2006/0014401 | A1 * | 1/2006 | Mae | G01R 1/0483 439/71 |
| 2008/0280495 | A1 * | 11/2008 | Ko | H01R 43/0256 439/638 |
| 2010/0120290 | A1 * | 5/2010 | Ko | H01R 13/502 439/626 |
| 2014/0335714 | A1 * | 11/2014 | Schrader | H01R 12/772 439/329 |
| 2015/0117001 | A1 * | 4/2015 | Fan | F21V 23/001 362/235 |
| 2015/0117005 | A1 * | 4/2015 | Zanotto | F21V 21/26 362/249.1 |
| 2015/0303632 | A1 * | 10/2015 | Tremaine | H01R 13/501 439/626 |
| 2015/0349457 | A1 * | 12/2015 | Shariff | H01R 13/6205 439/37 |
| 2016/0356454 | A1 * | 12/2016 | Camarota | F21V 7/005 |
| 2018/0031190 | A1 * | 2/2018 | Nicolai | F21V 23/04 |

OTHER PUBLICATIONS

Written Opinion of the International Searching Authority (USPTO) for international application PCT/US2016/029091 dated Jul. 26, 2016.

* cited by examiner

ELECTRICAL CONNECTOR SYSTEM FOR LED TAPE LIGHTING

BACKGROUND OF THE INVENTION

Tape lighting, sometimes referred to as strip lighting, is typically used for accent, mood, and other indirect lighting applications, but may also be used in direct lighting applications. Conventional tape lighting typically includes a series arrangement of light emitting diodes ("LEDs") disposed on a thin and flexible substrate and an adhesive on the opposing side of the substrate allowing for the peel-and-stick application of the tape lighting to its desired location. Power and optional control signaling is provided to the tape lighting by a multi-conductor cable or electrical connector system. Conventional electrical connector systems for tape lighting include screw down terminals, clamps or fittings, or mated headers and connectors that provide the required electrical continuity between the line side source of electrical power and the electrical loads.

BRIEF SUMMARY OF THE INVENTION

According to one aspect of one or more embodiments of the present invention, an electrical connector system for tape lighting includes a cap, a printed circuit board attached to a bottom side of the cap, and a tray. The cap includes a plurality of hinge pins disposed on transverse sides of the cap, a plurality of cap mounting holes that extend through the cap, a cap light cutout portion, and a plurality of cap retention features. The printed circuit board includes a plurality of printed circuit board mounting holes, a printed circuit board light cutout portion, a plurality of printed circuit board electrical contacts, and a plurality of pogo-pins that are electrically connected to the corresponding plurality of electrical contacts. The tray includes a plurality of hinge pin receivers formed in transverse sidewalls of the tray, a tray mounting surface, and a plurality of tray retention features. Each hinge pin receiver includes a first portion separated from a second portion by a pin retention feature. The plurality of pogo-pins are compressed by contact with a plurality of contact pads of a tape light attached to the tray mounting surface.

Other aspects of the present invention will be apparent from the following description and claims.

DETAILED DESCRIPTION OF THE INVENTION

Figure 1A:
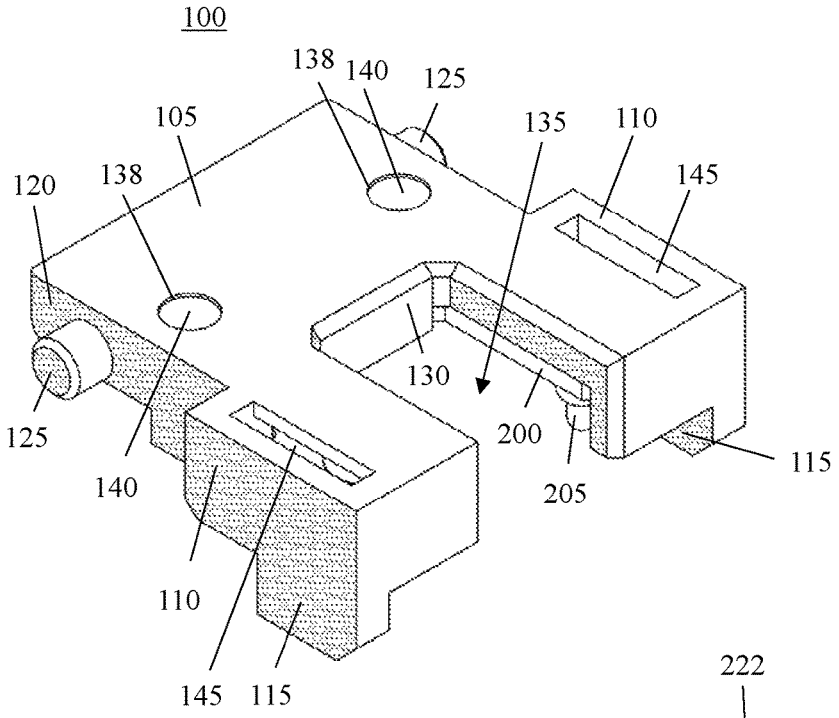
FIG. 1A shows a top-facing perspective view of a cap and a printed circuit board of an electrical connector system in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

Conventional electrical connector systems for tape lighting applications suffer from issues that make installation and de-installation difficult and time-consuming. Worse still, conventional electrical connector systems provide fragile and tenuous connectivity between the line side source of electrical power and the electrical loads. For example, in direct wiring applications a multi-conductor cable is soldered or otherwise attached directly to the tape lighting itself. The wires of the cable are soldered to a distal end of the tape lighting in advance of installation or soldered to the tape lighting on site during the installation. Because tape lighting is substantially flat, the soldered contact may fail breaking the desired electrical continuity and potentially resulting in a short circuit. Various failure modes, including stress and strain from potting, underfills, and conformal coatings, temperature variations, soldering defects, and most commonly mechanical stress from bending, may weaken and eventually break continuity. In addition, while the peel-and-stick application of tape lighting simplifies installation, making connections between the power source and the tape lighting is typically performed on location as the tape lighting is being installed. When soldering in location is required, making connections is difficult and slows down installation. Further, the nature of the connection is somewhat permanent requiring substantially more effort to redo or disconnect the power source from the tape lighting.

While solderless connectors including, for example, screw terminals, push-in connectors, splice connectors, and other fittings do not require soldering, they merely facilitate the joining together of discrete wires. As such, splices of wire must be soldered or otherwise attached to the tape lighting before such solderless connectors may be effectively used to make power and signaling connections. While clamp connectors and snap connectors do not require soldered connections, they typically require a specialized type or kind of tape lighting, damage the tape lighting in making the connection, or rely on a weak mechanical contact mechanism that is prone to undesired disconnection or failure due to mechanical stress. As such, there is a long felt and unsolved need in the industry for a quick, efficient, and robust electrical connector system for tape lighting applications.

Accordingly, in one or more embodiments of the present invention, an improved electrical connector system for tape lighting provides a quick, efficient, and robust power connection to tape lighting that has a small footprint, allows for the use of higher density tape lighting, alleviates shadows, and allows LEDs within the profile of the connector to effectively transmit light, improving the lighting results. The improved electrical connector system includes a plurality of pogo-pins that make a quick and removable connection to a plurality of contact pads of the tape lighting that is exceptionally strong and mechanically robust. In addition, the unique hinged cap and tray system includes a plurality of hinge pin receivers, each of which includes a first receiver portion separated from a second receiver portion by a pin retention feature. Advantageously, when the cap is closed on the tray, the cap may be pulled back such that the hinge pin travels from the first receiver portion to the second receiver portion and is held in place by the pin retention feature and the interference fit between a plurality of cap retention features and a plurality of tray retention features. The connection between cap and tray compress the pogo-pins such that they make a robust connection with pads of the tape light that simplifies making connections and disconnections in a non-permanent manner that may be easily installed on site.

FIG. 1A shows a top-facing perspective view of a cap 100 and printed circuit board ("PCB") (not independently illustrated) of an improved electrical connector system (e.g., 600) in accordance with one or more embodiments of the present invention. Cap 100 may include a body portion 105 having a substantially rectangular shape with a plurality of hinge pins 125 disposed on transverse sides 120 of a rear portion of body 105, a cap light cutout portion 135 formed in a front portion of body 105, and a plurality of protruding sidewall portions 110 disposed on a front portion of body 105 protruding from transverse sides 120 of body portion 105 near cap light cutout portion 135. In certain embodiments, cap light cutout portion 135 may be substantially U-shaped to accommodate the transmission of light from one or more LEDs (not shown) of a tape light (not shown), that are typically rectangular or square in shape, when the electrical connector system (e.g., 600) is in operative use. One of ordinary skill in the art will recognize that the size and shape of cap light cutout portion 135 may vary based on an application or design in accordance with one or more embodiments of the present invention.

Protruding sidewall portions 110 may protrude from transverse sides 120 of body portion 105 such that they are near-flush with (not shown), flush with (not shown), or protrude slightly beyond the plurality of hinge pins 125. Each protruding sidewall portion 110 may include a protruding retention portion 115, narrower than protruding sidewall portion 110, that protrudes down and away from body portion 105. Each protruding retention portion 115 may include a cap retention feature 155 that forms an interference fit with a corresponding tray retention feature (not shown) when the electrical connector system (not shown) is in operative use. In addition, each protruding sidewall portion 110 may include an access cutout 145 on a top side of body 105 that provides visual and physical access to the interference fit between a cap retention feature 155 and a tray retention feature (not shown). Cap 100 may include a plurality of cap mounting holes 138 that receive a plurality of mounting pins 140 that may be used to secure the PCB (not independently illustrated) to a bottom side (not shown) of cap 100. Cap 100 may also include a PCB retention feature 130, near a rear portion of cap light cutout portion 135, to assist positioning and securing the PCB (not shown) to cap 100.

Figure 1B:
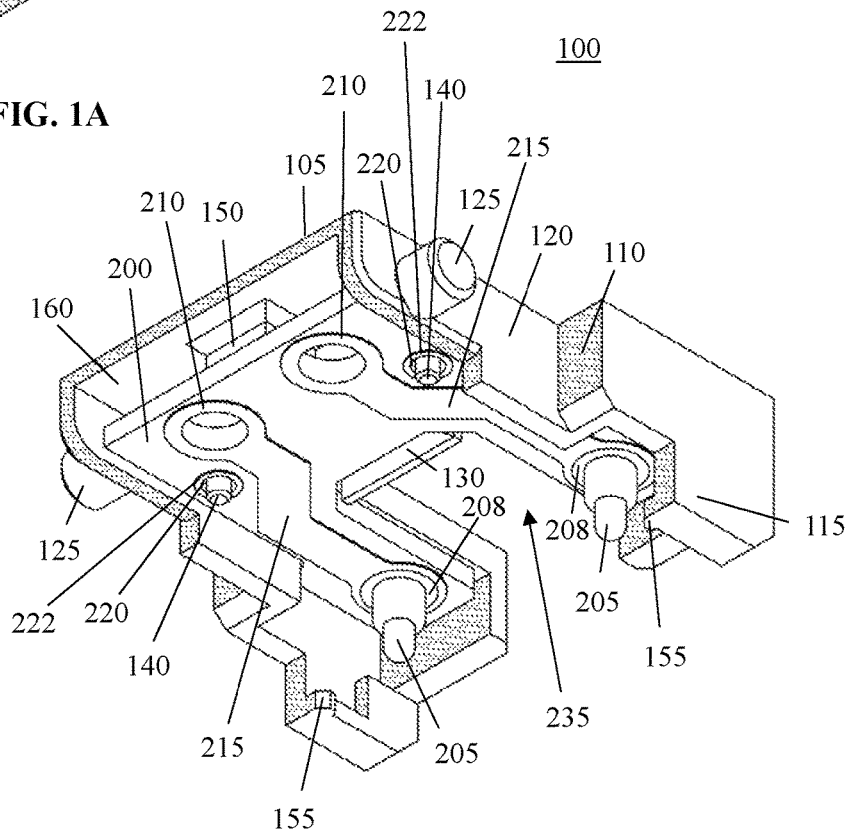
FIG. 1B shows a bottom-facing perspective view of the cap and printed circuit board of the electrical connector system in accordance with one or more embodiments of the present invention.

Continuing, FIG. 1B shows a bottom-facing perspective view of cap 100 and PCB 200 of the electrical connector system (not shown) in accordance with one or more embodiments of the present invention. A bottom side of body portion 105 may include an aperture 160 to receive PCB 200 within cap 100. PCB 200 may be, for example, a rigid member comprising flame retardant 4 ("FR4") circuit board material or a flexible circuit (not shown). PCB 200 may be disposed behind PCB retention feature 130 and bounded by recessed sides 120 and recessed portions of protruding sidewall portions 110 within aperture 160, while a back distal end may be exposed. PCB 200 may rest on a riser portion 150 disposed on the bottom side of body 105 of cap 100 that provides room for components or solder joints (not shown) of one or more through-hole portions of wires (not shown) disposed through PCB electrical contacts 210. PCB 200 may include a PCB light cutout portion 235 substantially similar in shape, size, and location to cap light cutout portion (e.g., 135) of body 105. That is, when mounted, PCB light cutout portion 235 may be substantially aligned with the cap light cutout portion (e.g., 135) such that one or more LEDs within the profile may transmit light freely. A plurality of mounting pins 140 may be disposed through the plurality of cap mounting holes (e.g., 138) through a corresponding plurality of PCB mounting holes 220 and soldered to solder pads 222 to secure PCB 200 to cap 100. One of ordinary skill in the art will recognize that other standardized PCB mounting mechanisms may be used in accordance with one or more embodiments of the present invention.

PCB 200 may include a plurality of PCB electrical contacts 210 that provide connectivity to a line side power source (not shown). The plurality of PCB electrical contacts 210 may be through-hole (as depicted) or surface-mounted pads (not shown) configured to receive a plurality of wires (not shown). One of ordinary skill in the art will recognize that the type or kind of electrical contacts may vary based on an application or design in accordance with one or more embodiments of the present invention. The line side power source wires (not shown) may be soldered to the plurality of PCB electrical contacts 210. Each of the plurality of PCB electrical contacts 210 may be connected to a corresponding PCB pogo-pin contact 208 by a PCB electrical path, sometimes referred to as a trace, 215. A plurality of pogo-pins 205 may be attached to the corresponding plurality of PCB pogo-pin contacts 208. For example, pogo-pins 205 may be soldered to their PCB pogo-pin contacts 208. As such, there is electrical continuity between each PCB electrical contact 210 and its corresponding PCB pogo-pin contact 208 and attached pogo-pin 205. Each pogo-pin 205 may be a conductor that is substantially cylindrical in shape having a primary body portion attached to the PCB pogo-pin contact 208 and a secondary body portion that is spring-loaded with respect to the primary body portion such that it is capable of being compressed under spring load. Each protruding retention portion 115 may include a cap retention feature 155 that forms an interference fit with a corresponding tray retention feature (not shown) when the electrical connector system (not shown) is in operative use.

Figure 1C:
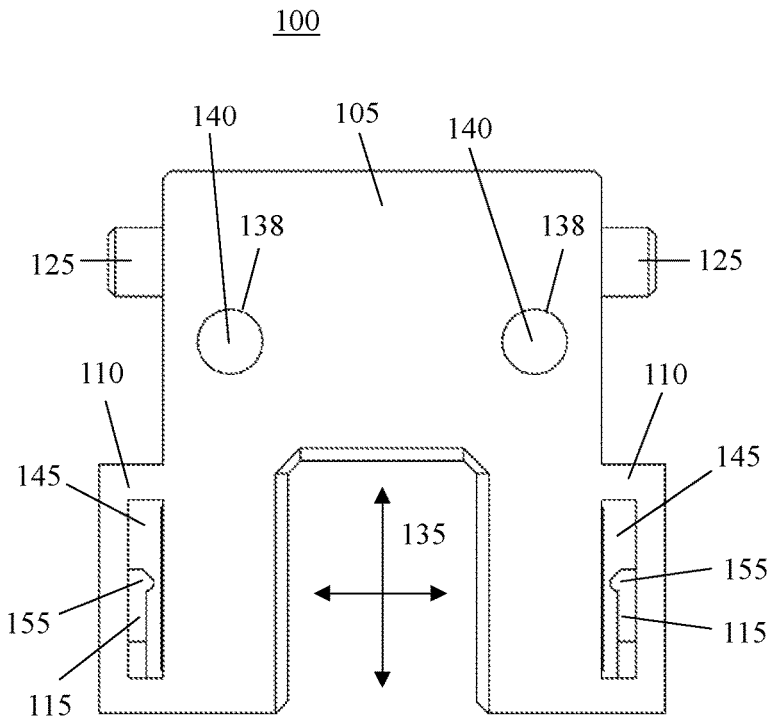
FIG. 1C shows a top plan view of the cap and printed circuit board of the electrical connector system in accordance with one or more embodiments of the present invention.
Figure 1D:
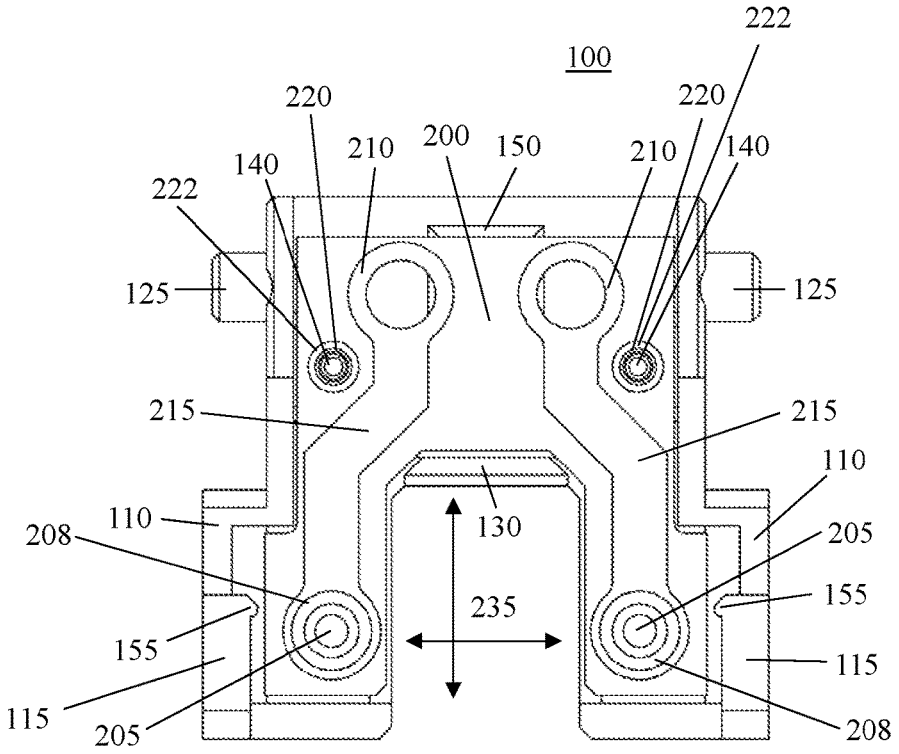
FIG. 1D shows a bottom plan view of the cap and printed circuit board of the electrical connector system in accordance with one or more embodiments of the present invention.

Continuing, FIG. 1C shows a top plan view of cap 100 and PCB 200 of the electrical connector system (not shown) in accordance with one or more embodiments of the present invention. As previously discussed, cap light cutout portion 135 may be substantially U-shaped to accommodate the transmission of light from one or more LEDs (not shown) of a tape light (not shown), that are typically rectangular or square in shape, when the electrical connector system (not shown) is in operative use. In certain embodiments, cap light cutout portion 135 may be chamfered or otherwise radiused in the corners to facilitate manufacturability. Protruding sidewall portions 110 may protrude from the transverse sides (e.g., 120) of body portion 105 such that they are near-flush with (not shown), flush with (not shown), or protrude slightly beyond the plurality of hinge pins 125. Each protruding sidewall portion 110 may include an access cutout 145 on the top side of body 105 that provides visual and physical access to the interference fit between cap retention feature 155 and the tray retention feature (not shown). Continuing, FIG. 1D shows a bottom plan view of cap 100 and PCB 200 of the electrical connector system (not shown) in accordance with one or more embodiments of the present invention. The plurality of pogo-pins 205 may be attached to PCB pogo-pin contacts 208 of PCB 200 that are located on the sides that bound PCB light cutout portion 235. As such, electrical continuity with electrical contacts of the tape light (not shown) may be made adjacent to, in front of, or behind, one or more LEDs (not shown) of the tape light (not shown) when the electrical connector system (not shown) is in operative use.

Figure 1E:
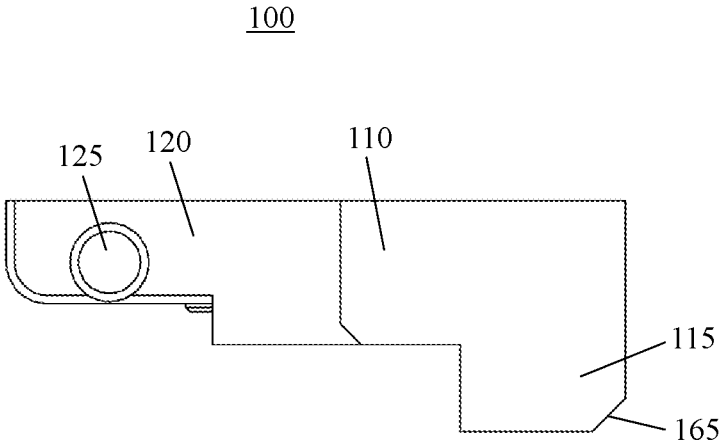
FIG. 1E shows a left-side elevation view of the cap and printed circuit board of the electrical connector system in accordance with one or more embodiments of the present invention.
Figure 1F:
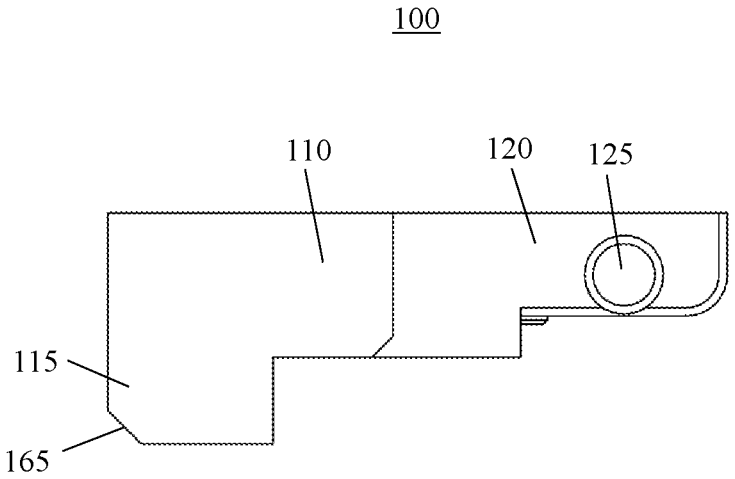
FIG. 1F shows a right-side elevation view of the cap and printed circuit board of the electrical connector system in accordance with one or more embodiments of the present invention.

Continuing, FIG. 1E shows a left-side elevation view of cap 100 and PCB 200 of the electrical connector system (not shown) in accordance with one or more embodiments of the present invention. Recessed sides 120 and protruding sidewall portion 110 may have different depth to facilitate mating with the tray (not shown). Protruding retention portion 115 may have a larger depth than protruding sidewall portion 110 to facilitate engagement with the tray (not shown) and form the interference fit between the cap retention feature (e.g., 155) and the tray retention feature (not shown). Various edges, including, for example, a front facing edge 165 of protruding retention portion 115 may be chamfered or radiused to facilitate engagement with the tray (not shown), in this instance, the tape alignment features (not shown) of the tray (not shown). Continuing, FIG. 1F shows a right-side elevation view of cap 100 of the electrical connector system in accordance with one or more embodiments of the present invention.

Figure 1G:
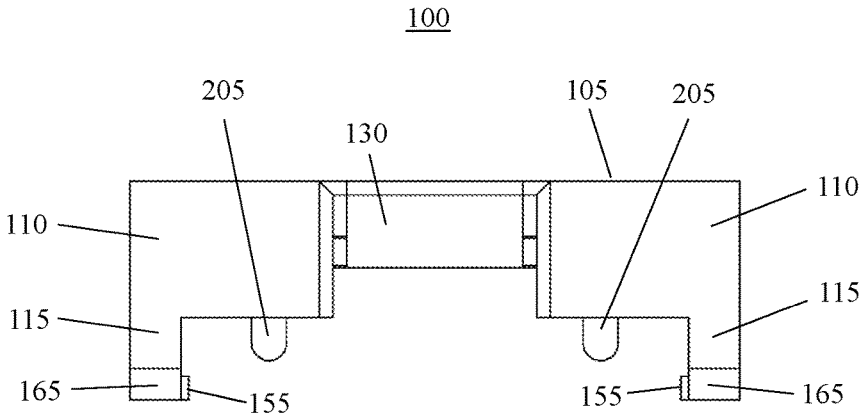
FIG. 1G shows a front elevation view of the cap and printed circuit board of the electrical connector system in accordance with one or more embodiments of the present invention.
Figure 1H:
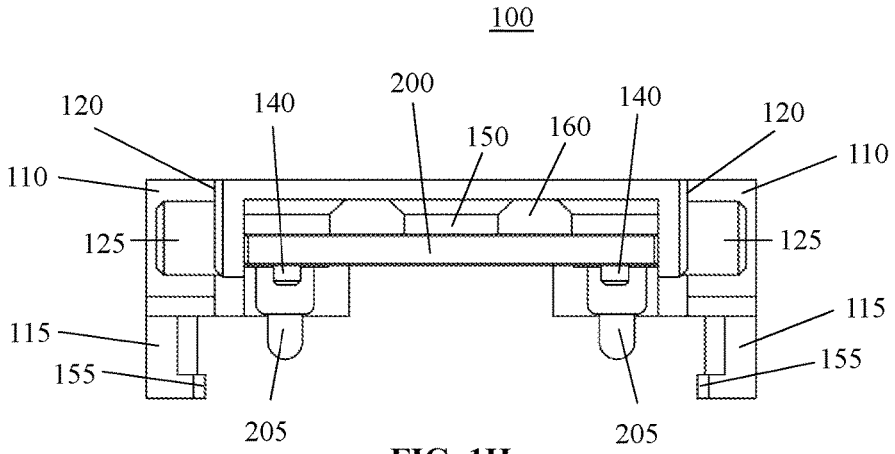
FIG. 1H shows a rear elevation view of the cap and printed circuit board of the electrical connector system in accordance with one or more embodiments of the present invention.

Continuing, FIG. 1G shows a front elevation view of cap 100 and PCB 200 of the electrical connector system (not shown) in accordance with one or more embodiments of the present invention. In this view, a distal end of the secondary portion of the plurality of pogo-pins 205 extending beyond the protruding sidewall portions 110 may be seen. In addition, the plurality of cap retention features 155 are shown facing inward for engagement with the plurality of tray retention features (not shown) of the tray (not shown) facing outward when the electrical connector system (not shown) is in operative use. Continuing, FIG. 1H shows a rear elevation view of cap 100 and PCB 200 of the electrical connector system (not shown) in accordance with one or more embodiments of the present invention. As discussed above, PCB 200 may be disposed within the cavity 160 of body portion 105 such that it is bounded by recessed sides 120 and PCB retention feature 130. PCB 200 may rest on a riser portion 150 disposed on the bottom side of body 105 of cap 100 to provide room for solder joints (not shown) of one or more through-hole portions of wires (not shown) disposed through PCB electrical contacts 210. The plurality of mounting pins 140 may be disposed through the plurality of cap mounting holes 138 and the corresponding plurality of PCB mounting holes 220.

Figure 2A:
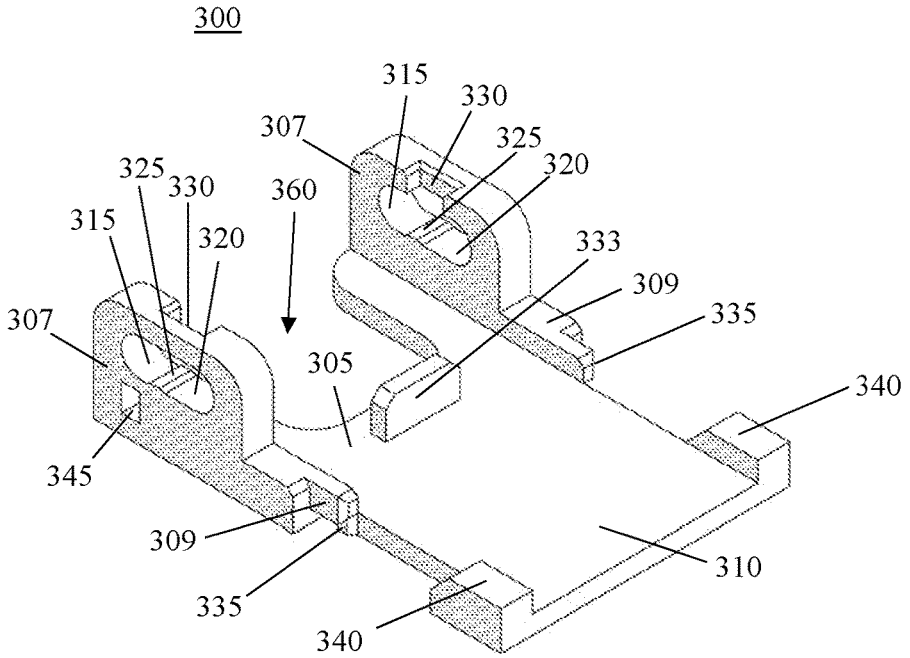
FIG. 2A shows a top-facing perspective view of a tray of the electrical connector system in accordance with one or more embodiments of the present invention.

FIG. 2A shows a top-facing perspective view of a tray 300 of the electrical connector system (not shown) in accordance with one or more embodiments of the present invention. Tray 300 may include a body portion 305 having a substantially rectangular shape with a substantially U-shaped cable cutout portion 360 formed in the rear portion of body 305. Tray 300 may include a plurality of protruding receiver portions 307 that protrude upward from transverse sides of body 305. Each protruding receiver portion 307 may include a hinge pin receiver to receive the plurality of hinge pins (e.g., 125) of the cap (e.g., 100). Each hinge pin receiver may include a first receiver portion 320 and a second perceiver portion 315 separated by a pin retention feature 325. A plurality of pin insertion cutouts 330 may facilitate insertion of the plurality of hinge pins (e.g., 125) of the cap (e.g., 100), when the cap (e.g., 100) is attached to tray 300. An optional plurality of shroud connection ports 345 may be formed in transverse sides of protruding receiver portions 307 to receive and secure a cable shroud (not shown) to the electrical connector system (not shown).

Figure 2B:
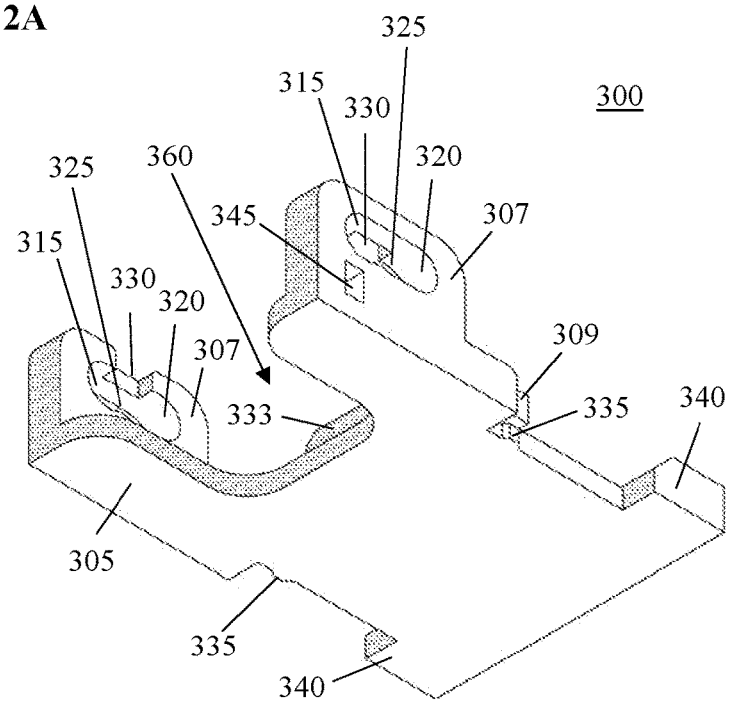
FIG. 2B shows a bottom-facing perspective view of the tray of the electrical connector system in accordance with one or more embodiments of the present invention.

A plurality of tape alignment features 340 may be disposed on transverse sides of a front portion of body 305 to facilitate alignment of a portion of a tape light (not shown) as it is being installed and a tape backstop feature 333 may prevent over insertion of the tape light (not shown) into tray 300 and properly position the tape light electrical contacts (not shown) for engagement with the pogo-pins (e.g., 205). Tray 300 may include a tray mounting surface 310 configured to receive an adhesive side of the portion of the tape light (not shown) inserted onto tray 300. A plurality of tray retention features 335 may form an interference with the plurality of cap retention features (e.g., 155) of the cap (e.g., 100) and may be disposed on transverse sides of body 305 below protruding portions 309. Continuing, FIG. 2B shows a bottom-facing perspective view of tray 300 of the electrical connector system (not shown) in accordance with one or more embodiments of the present invention. Cable cutout portion 360 may allow the electrical line side cable (not shown) attached to the cap (e.g., 100) to move when the cap (e.g., 100) is opened without bending or otherwise imposing mechanical stress on the cable or wires thereof (not shown).

Figure 2C:
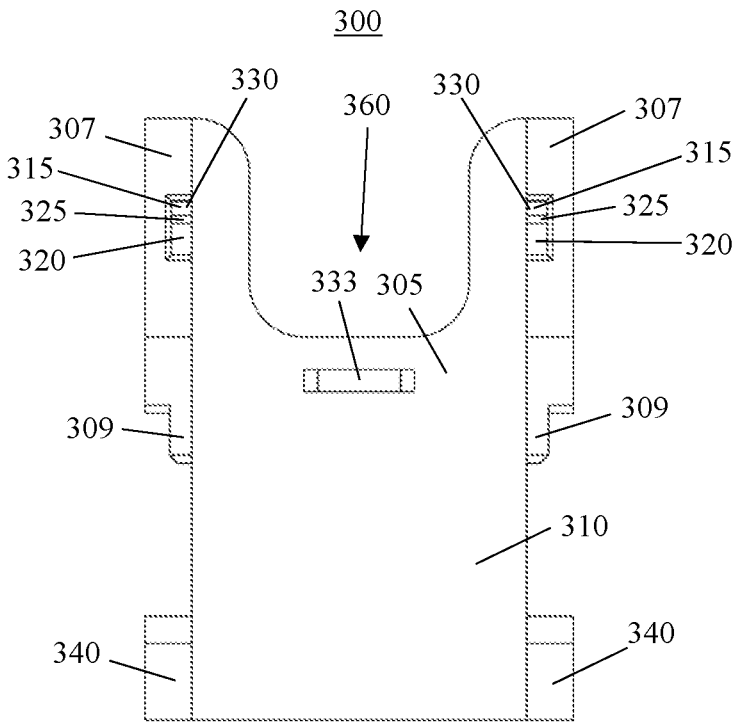
FIG. 2C shows a top plan view of the tray of the electrical connector system in accordance with one or more embodiments of the present invention.
Figure 2D:
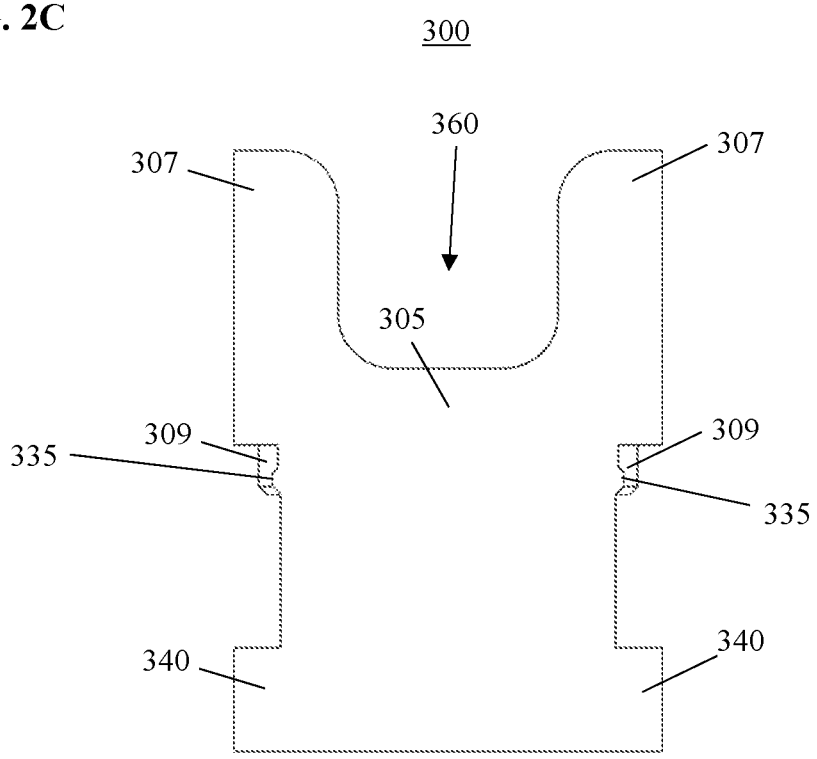
FIG. 2D shows a bottom plan view of the tray of the electrical connector system in accordance with one or more embodiments of the present invention.

Continuing, FIG. 2C shows a top plan view of tray 300 of the electrical connector system (not shown) in accordance with one or more embodiments of the present invention. When making a connection, an adhesive side (not shown) of a tape light (not shown) may be guided into position using tape alignment features 340 and tape backstop portion 333 and affixed to tray mounting surface 310. The plurality of hinge pins (e.g., 125) may be guided into position within their respective hinge pin receivers by way of their respective pin insertion cutout 330 when connecting the cap (e.g., 100) to tray 300. Continuing, FIG. 2D shows a bottom plan view of tray 300 of the electrical connector system (not shown) in accordance with one or more embodiments of the present invention. When the cap (e.g., 100) is closed and being locked to tray 300, the plurality of cap retention features (e.g., 155) engage the plurality of tray retention features 335. A bottom side of tray 300 may be flat such that it may lie substantially flat with respect to tape light (not shown) that may be affixed to a surface.

Figure 2E:
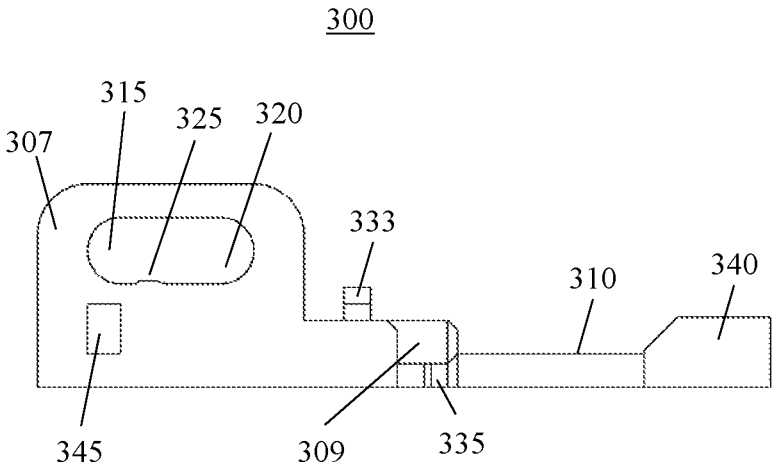
FIG. 2E shows a left-side elevation view of the tray of the electrical connector system in accordance with one or more embodiments of the present invention.
Figure 2F:
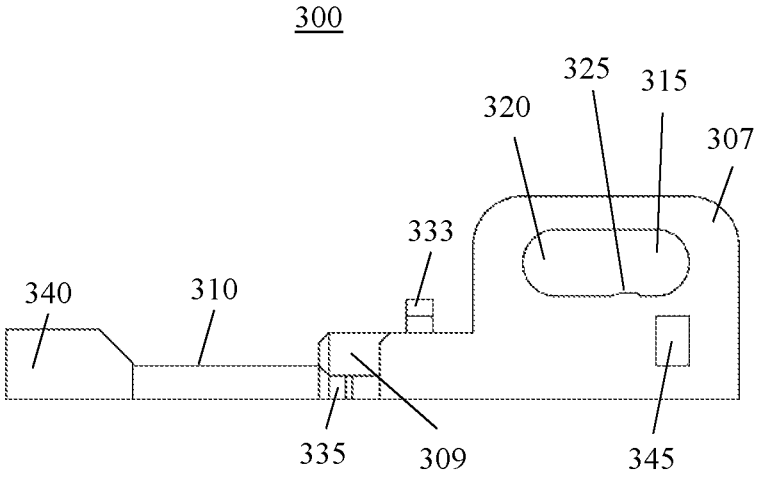
FIG. 2F shows a right-side elevation view of the tray of the electrical connector system in accordance with one or more embodiments of the present invention.

Continuing, FIG. 2E shows a left-side elevation view of tray 300 of the electrical connector system (not shown) in accordance with one or more embodiments of the present invention. As discussed above, each hinge pin receiver may include a first receiver portion 320 and a second perceiver portion 315 separated by a pin retention feature 325. Each hinge pin (e.g., 125) may travel within the hinge pin receiver from the first receiver portion 320 to the second receiver portion 315 when the cap (e.g., 100) is closed and locked into place with respect to tray 300. Continuing, FIG. 2F shows a right-side elevation view of tray 300 of the electrical connector system (not shown) in accordance with one or more embodiments of the present invention. Each cap retention feature (e.g., 155) may form an interference fit with its corresponding tray retention feature 335 when the cap (e.g., 100) is closed and locked into place with respect to tray 300.

Figure 2G:
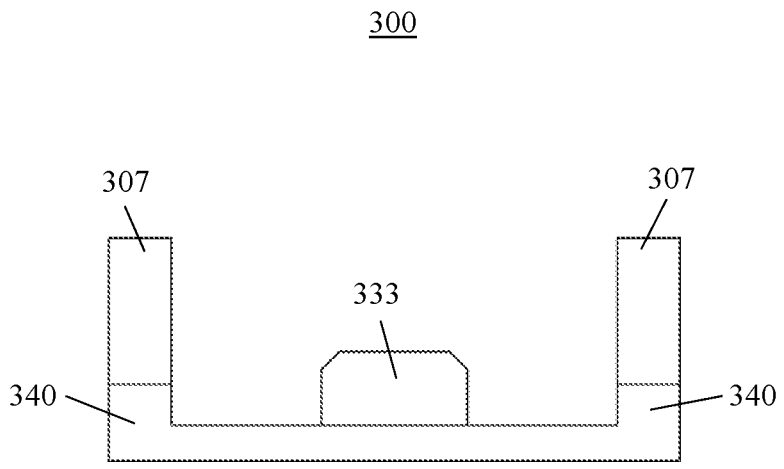
FIG. 2G shows a front elevation view of the tray of the electrical connector system in accordance with one or more embodiments of the present invention.
Figure 2H:
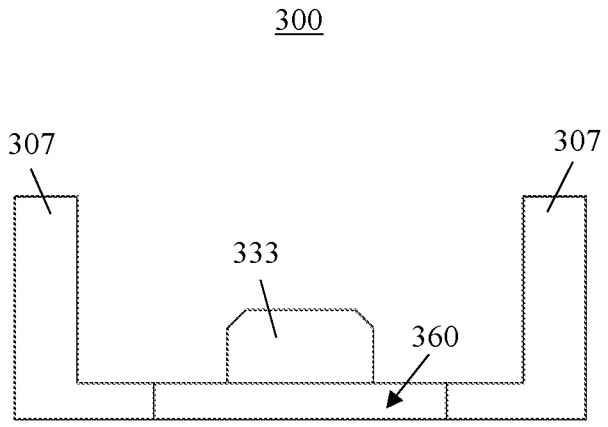
FIG. 2H shows a rear elevation view of the tray of the electrical connector system in accordance with one or more embodiments of the present invention.

Continuing, FIG. 2G shows a front elevation view of tray 300 of the electrical connector system (not shown) in accordance with one or more embodiments of the present invention. Continuing, FIG. 2H shows a rear elevation view of tray 300 of the electrical connector system (not shown) in accordance with one or more embodiments of the present invention.

Figure 3:
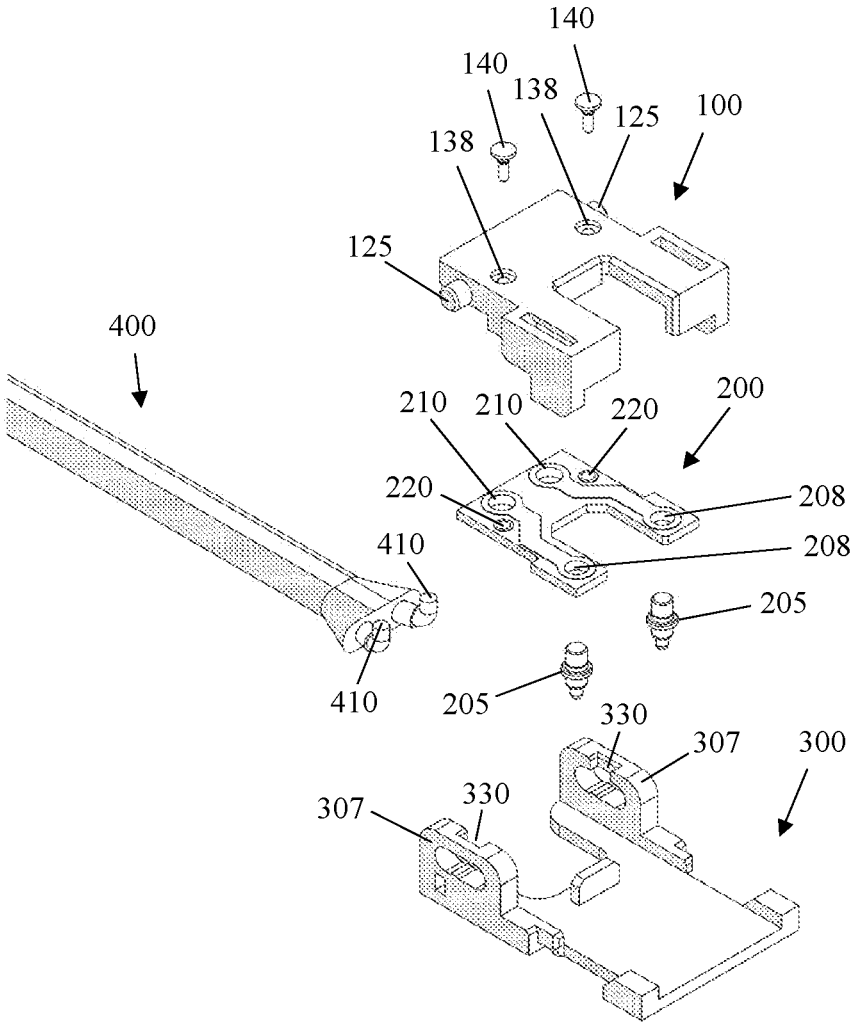
FIG. 3 shows an exploded view of an electrical connector system with multi-conductor cable in accordance with one or more embodiments of the present invention.

FIG. 3 shows an exploded view of an electrical connector system 600 with multi-conductor cable 400 in accordance with one or more embodiments of the present invention. A plurality of pogo-pins 205 may be attached to a corresponding plurality of PCB pogo-pin contacts 208. In certain embodiments, the plurality of PCB pogo-pin contacts 208 may be through-hole pads or partial through-hole pads that have metallic surfaces that are capable of being soldered. The plurality of pogo-pins 205 may be partially inserted into corresponding through-hole pads or partial through-hole pads and soldered in place. Similarly, a plurality of wires 410 of a multi-conductor cable 400 may be inserted into a corresponding plurality of PCB electrical contacts 210 and soldered into place. PCB 200 may be disposed within the aperture (e.g., 160) on the bottom side of cap 100 bounded by PCB retention feature 130, recessed sides 120, and recessed portions of protruding sidewall portions 110, but exposed in the back. When PCB 200 is properly placed with respect to cap 100, a plurality of cap mounting holes 138 may be aligned with a plurality of PCB mounting holes 220. A plurality of mounting pins 140 may be disposed through cap mounting holes 138 and PCB mounting holes 220 and soldered in place (e.g., 222) to affix PCB 200 to cap 100. Cap 100, with PCB 200 attached, may then be inserted into tray 300. Specifically, the plurality of hinge pins 125 may be guided into the plurality of hinge pin receivers of tray 300 by way of a plurality of pin insertion cutouts 330. While the plurality of hinge pins 125 may have a width wider than that allowed by the plurality of pin insertion cutouts 330, protruding receiver portions 307 may flex somewhat under force allowing for insertion of the plurality of hinge pins 125 into the plurality of hinge pin receivers. A distal end (not shown) of multi-conductor cable 400 may attach to a power source (not shown) and one or more wires 410 may provide one or more power or signaling connections (not shown) to the tape light (not shown). In certain embodiments, the wires 410 may provide 12 VDC and ground. In other embodiments, the wires 410 may provide 24 VDC and ground. One of ordinary skill in the art will recognize that the power and signaling connections may vary based on an application or design in accordance with one or more embodiments of the present invention.

Figure 4A:
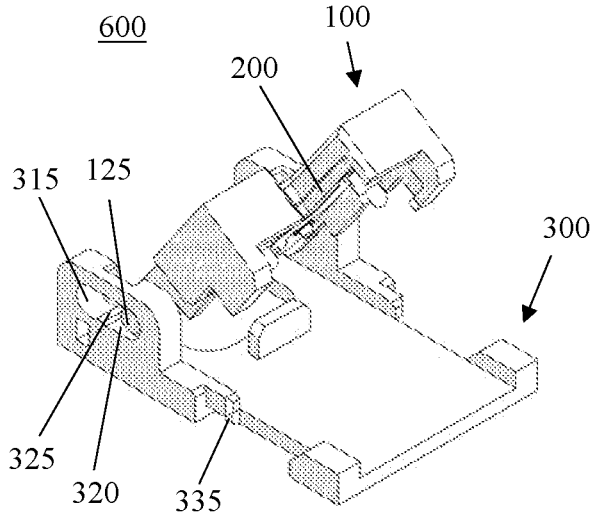
FIG. 4A shows a top-facing perspective view of a cap and a tray of an electrical connector system with the cap in an opened position in accordance with one or more embodiments of the present invention.
Figure 4B:
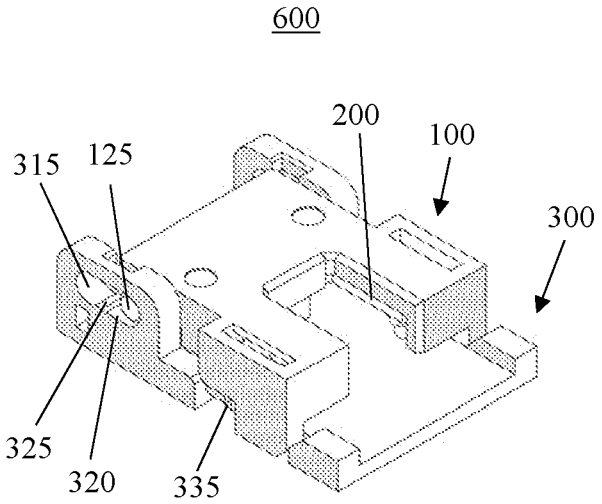
FIG. 4B shows a top-facing perspective view of the cap and tray of the electrical connector system with the cap closed on the tray in an unlocked position in accordance with one or more embodiments of the present invention.
Figure 4C:
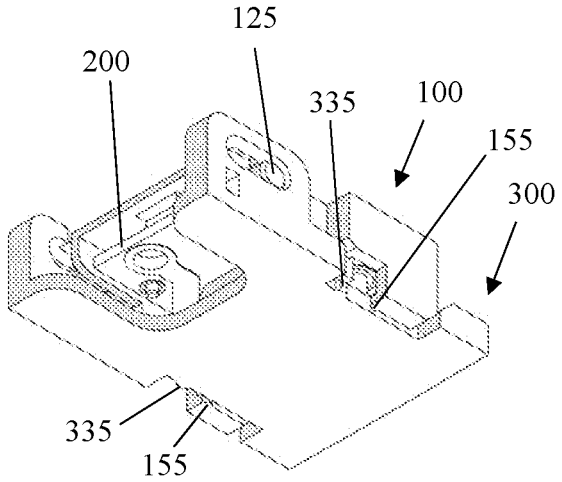
FIG. 4C shows a bottom-facing perspective view of the cap and tray of the electrical connector system with the cap closed on the tray in an unlocked position in accordance with one or more embodiments of the present invention.

FIG. 4A shows a top-facing perspective view of a cap 100 and a tray 300 of an electrical connector system 600 with cap 100 in an opened position in accordance with one or more embodiments of the present invention. The plurality of hinge pins 125 may be disposed in the plurality of first receiver portions (e.g., 320) of the plurality of hinge pin receivers such that cap 100 may open as depicted. Continuing, FIG. 4B shows a top-facing perspective view of cap 100 and tray 300 of electrical connector system 600 with cap 100 closed on tray 300 in an unlocked position in accordance with one or more embodiments of the present invention. When cap 100 is closed while the plurality of hinge pins 125 remain in the plurality of first receiver portions (e.g., 320) of the plurality of hinge pin receivers, cap 100 retains freedom of movement and is capable of being opened. Continuing, FIG. 4C shows a bottom-facing perspective view of cap 100 and tray 300 of electrical connector system 600 with cap 100 closed on tray 300 in an unlocked position in accordance with one or more embodiments of the present invention. In the unlocked position, the plurality of cap retention features (e.g., 155) are not engaged with the plurality of tray retention features 335.

Figure 4D:
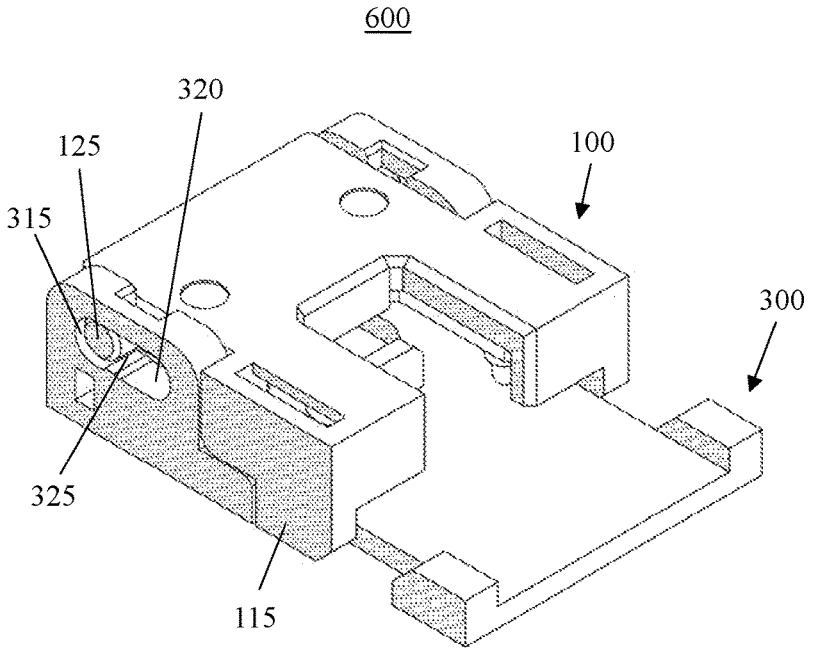
FIG. 4D shows a top-facing perspective view of the cap and tray of the electrical connector system with the cap closed on the tray in a locked position in accordance with one or more embodiments of the present invention.
Figure 4E:
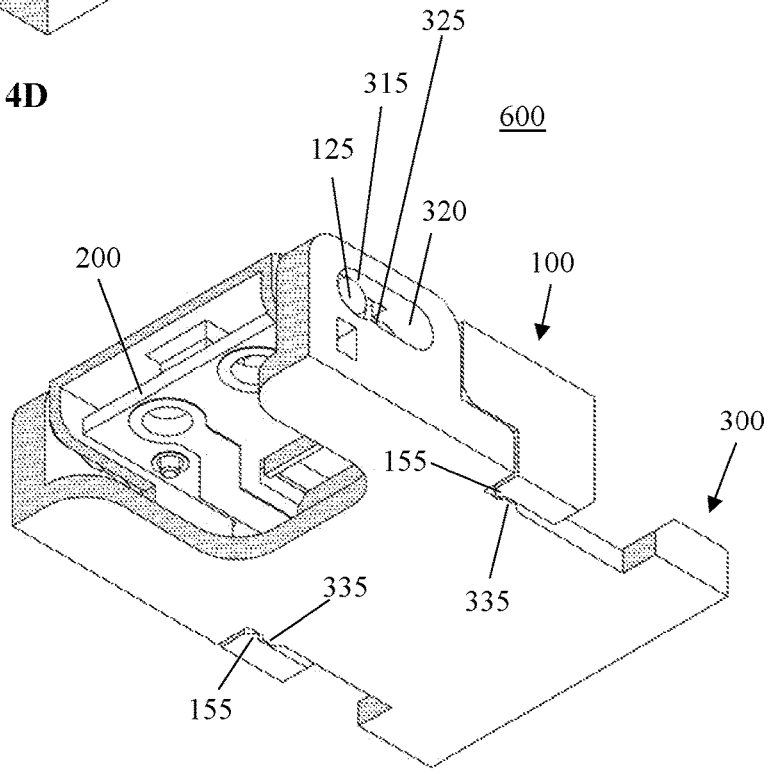
FIG. 4E shows a bottom-facing perspective view of the cap and tray of the electrical connector system with the cap closed on the tray in a locked position in accordance with one or more embodiments of the present invention.
Figure 4F:
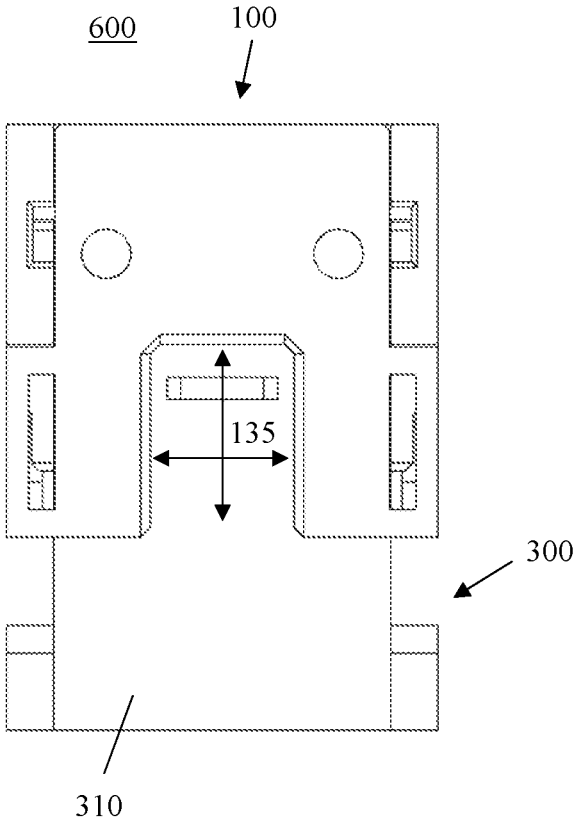
FIG. 4F shows a top plan view of the cap and tray of the electrical connector system with the cap closed on the tray in the locked position in accordance with one or more embodiments of the present invention.
Figure 4G:
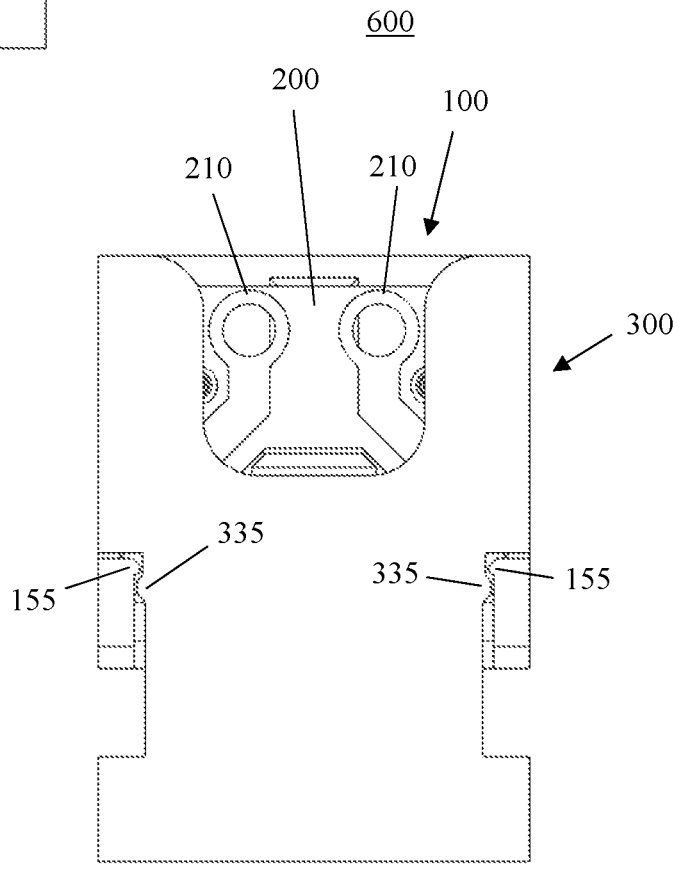
FIG. 4G shows a bottom plan view of the cap and tray of the electrical connector system with the cap closed on the tray in the locked position in accordance with one or more embodiments of the present invention.

Continuing, FIG. 4D shows a top-facing perspective view of cap 100 and tray 300 of electrical connector system 600 with cap 100 closed on tray 300 in a locked position in accordance with one or more embodiments of the present invention. When transitioning to the locked position, the plurality of hinge pins 125 travel from the plurality of first receiver portions 320 to the plurality of second receiver portions 315 and are partially secured in place by the plurality of pin retention features 325. Continuing, FIG. 4E shows a bottom-facing perspective view of cap 100 and tray 300 of electrical connector system 600 with cap 100 closed on tray 300 in a locked position in accordance with one or more embodiments of the present invention. When in the locked position, the plurality of cap retention features 155 may engage the plurality of tray retention features 335. Continuing, FIG. 4F shows a top plan view of cap 100 and tray 300 of electrical connector system 600 with cap 100 closed on tray 300 in the locked position in accordance with one or more embodiments of the present invention. Continuing, FIG. 4G shows a bottom plan view of cap 100 and tray 300 of electrical connector system 600 with cap 100 closed on tray 300 in the locked position in accordance with one or more embodiments of the present invention. In this view, engagement of the plurality of cap retention features 155 and the plurality of tray retention features 335 may be seen.

Figure 4H:
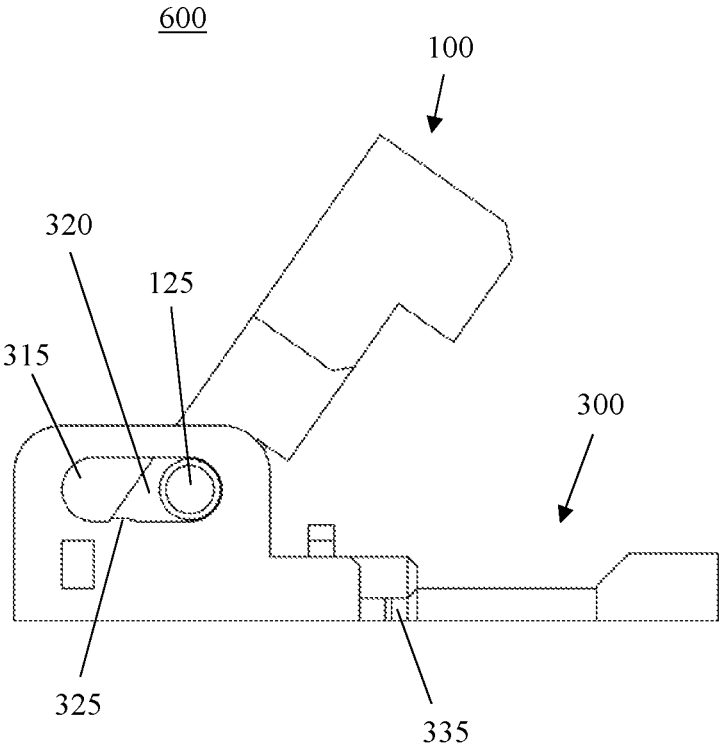
FIG. 4H shows a left-side elevation view of the cap and tray of the electrical connector system with the cap in an opened position in accordance with one or more embodiments of the present invention.
Figure 4I:
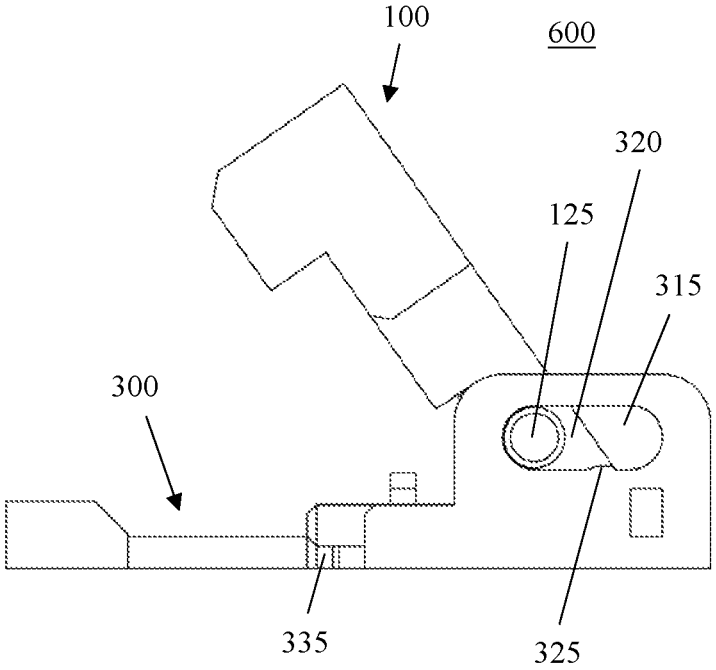
FIG. 4I shows a right-side elevation view of the cap and tray of the electrical connector system with the cap in an opened position in accordance with one or more embodiments of the present invention.
Figure 4J:
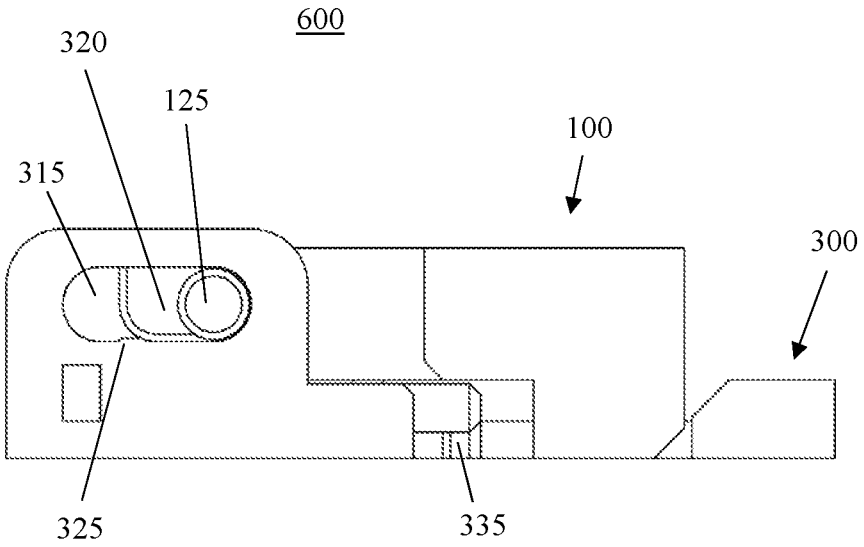
FIG. 4J shows a left-side elevation view of the cap and tray of the electrical connector system with the cap closed on the tray in an unlocked position in accordance with one or more embodiments of the present invention.
Figure 4K:
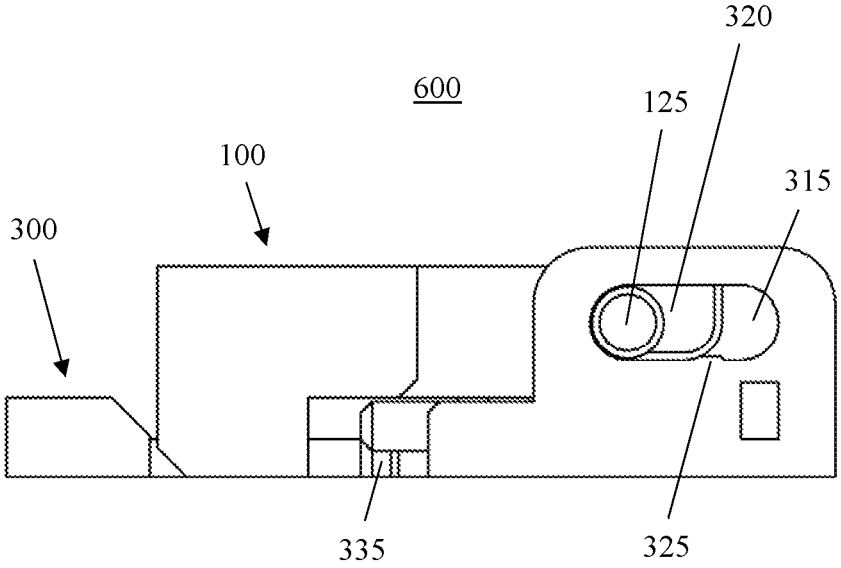
FIG. 4K shows a right-side elevation view of the cap and tray of the electrical connector system with the cap closed on the tray in an unlocked position in accordance with one or more embodiments of the present invention.

Continuing, FIG. 4H shows a left-side elevation view of cap 100 and tray 300 of electrical connector system 600 with cap 100 in an opened position in accordance with one or more embodiments of the present invention. Continuing, FIG. 4I shows a right-side elevation view of cap 100 and tray 300 of electrical connector system 600 with cap 100 in an opened position in accordance with one or more embodiments of the present invention. Continuing, FIG. 4J shows a left-side elevation view of cap 100 and tray 300 of electrical connector system 600 with cap 100 closed on tray 300 in an unlocked position in accordance with one or more embodiments of the present invention. Continuing, FIG. 4K shows a right-side elevation view of cap 100 and tray 300 of electrical connector system 600 with cap 100 closed on tray 300 in an unlocked position in accordance with one or more embodiments of the present invention.

Figure 4L:
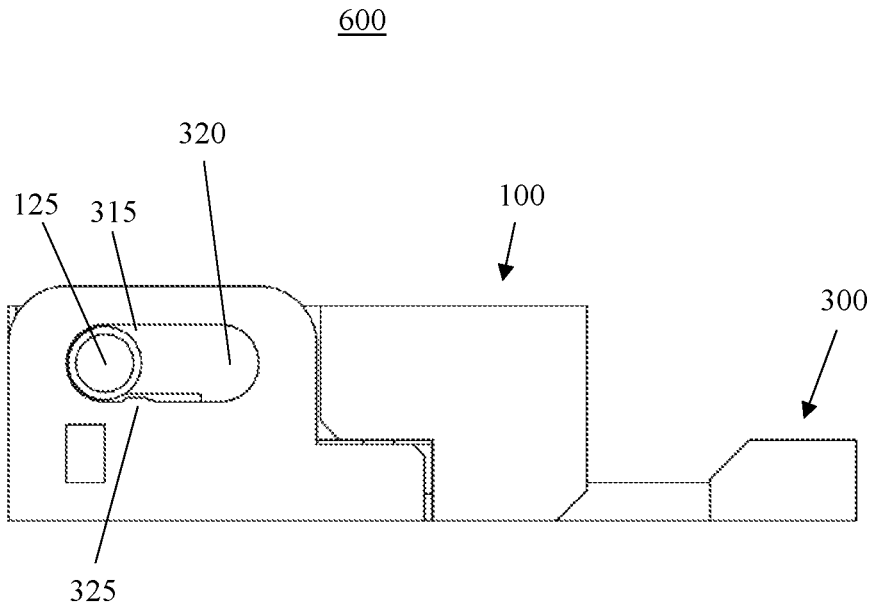
FIG. 4L shows a left-side elevation view of the cap and tray of the electrical connector system with the cap closed on the tray in a locked position in accordance with one or more embodiments of the present invention.
Figure 4M:
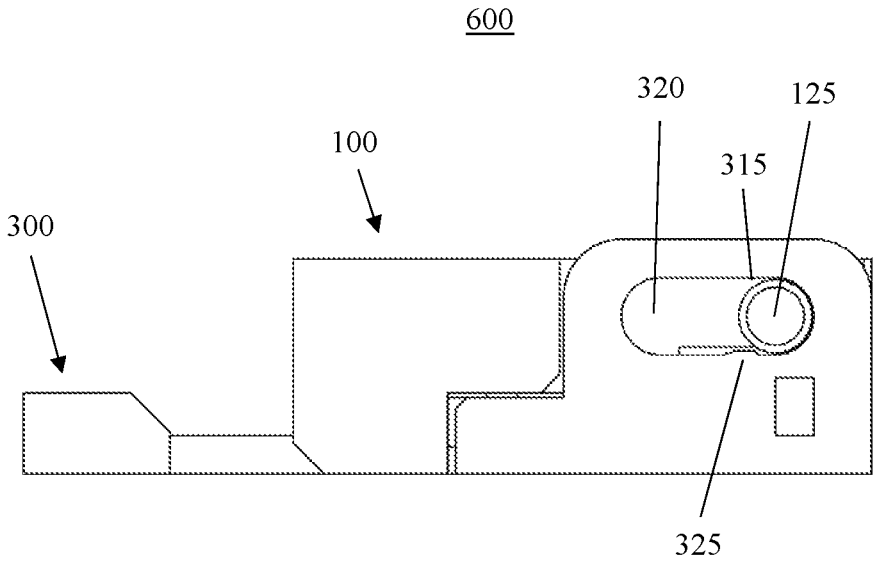
FIG. 4M shows a right-side elevation view of the cap and tray of the electrical connector system with the cap closed on the tray in a locked position in accordance with one or more embodiments of the present invention.
Figure 4N:
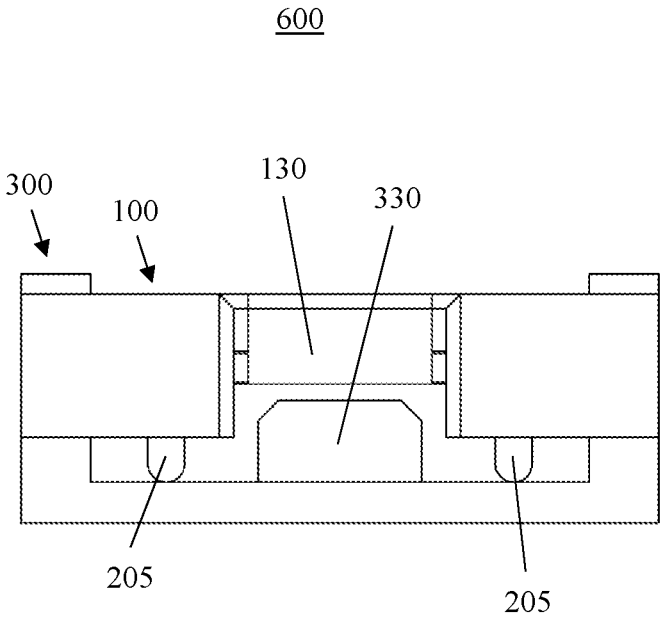
FIG. 4N shows a front elevation view of the cap and tray of the electrical connector system with the cap closed on the tray in a locked position in accordance with one or more embodiments of the present invention.
Figure 4O:
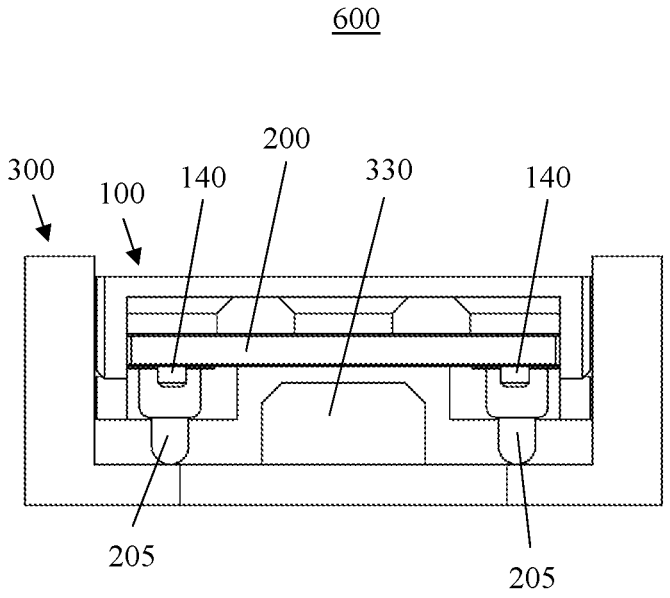
FIG. 4O shows a rear elevation view of the cap and tray of the electrical connector system with the cap closed on the tray in a locked position in accordance with one or more embodiments of the present invention.

Continuing, FIG. 4L shows a left-side elevation view of cap 100 and tray 300 of electrical connector system 600 with cap 100 closed on tray 300 in a locked position in accordance with one or more embodiments of the present invention. Continuing, FIG. 4M shows a right-side elevation view of cap 100 and tray 300 of electrical connector system 600 with cap 100 closed on tray 300 in a locked position in accordance with one or more embodiments of the present invention. Continuing, FIG. 4N shows a front elevation view of cap 100 and tray 300 of electrical connector system 600 with cap 100 closed on tray 300 in a locked position in accordance with one or more embodiments of the present invention. Continuing, FIG. 4O shows a rear elevation view of cap 100 and tray 300 of electrical connector system 600 with cap 100 closed on tray 300 in a locked position in accordance with one or more embodiments of the present invention.

Figure 5A:
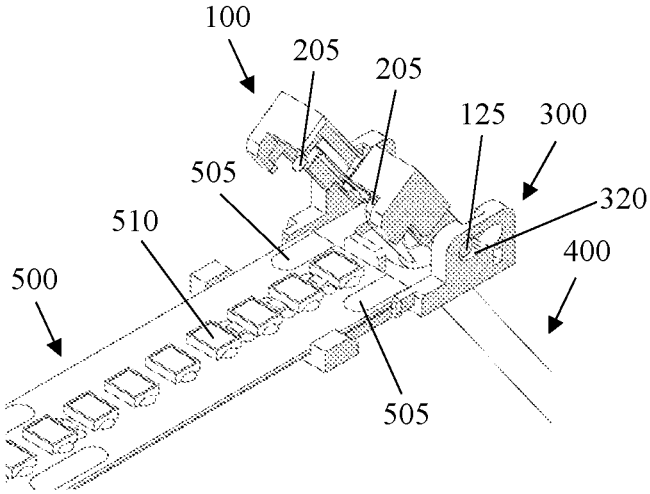
FIG. 5A shows an environmental perspective view of an electrical connector system with an electrical line side multi-conductor cable and LED tape light with the cap in an opened position in accordance with one or more embodiments of the present invention.

FIG. 5A shows an environmental perspective view of an electrical connector system 600 with a multi-conductor cable 400 and LED tape light 500 with a cap 100 in an opened position in accordance with one or more embodiments of the present invention. With cap 100 in the opened position, the adhesive side of a distal end of LED tape light 500 may attached to the tray mounting surface (e.g., 310). A plurality of tape light electrical contacts 505 may be positioned for contact with the plurality of pogo-pins 205 when cap 100 is closed on tray 300 and transitioned into the locked position. The plurality of hinge pins 125 may be disposed in the plurality of first receiver portions 320 allowing cap 100 to freely open and close. The cable cutout portion (e.g., 360) may allow multi-conductor cable 400 to move freely when cap 100 opens without imposing mechanical stresses on the contacts of cable 400. Advantageously, the act of opening and closing the electrical connector system 600 does not impose mechanical stresses on the cable 400 contacts attached to the PCB (not independently shown).

Figure 5B:
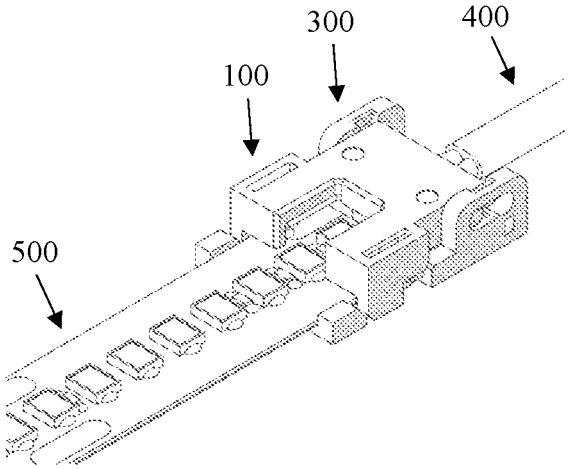
FIG. 5B shows an environmental perspective view of the electrical connector system with the electrical line side multi-conductor cable and LED tape light with the cap closed on the tray in an unlocked position in accordance with one or more embodiments of the present invention.
Figure 5C:
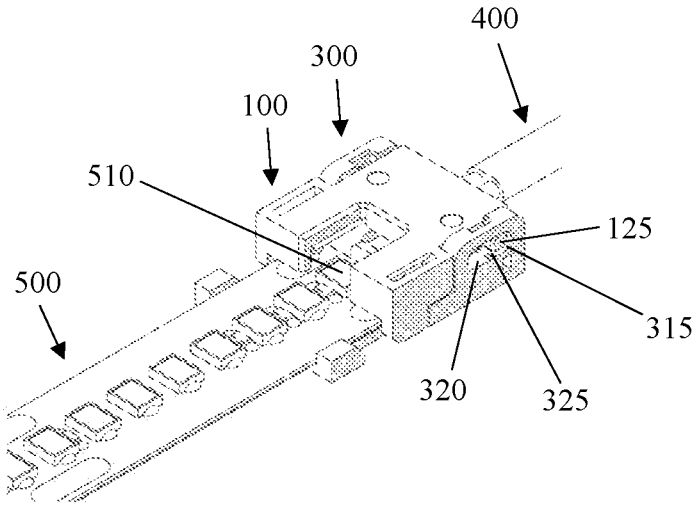
FIG. 5C shows an environmental perspective view of the electrical connector system with the electrical line side multi-conductor cable and LED tape light with the cap closed on the tray in a locked position in accordance with one or more embodiments of the present invention.

Continuing, FIG. 5B shows an environmental perspective view of electrical connector system 600 with electrical line side multi-conductor cable 400 and LED tape light 500 with cap 100 closed on tray 300 in an unlocked position in accordance with one or more embodiments of the present invention. Cap 100 may be closed on tray 300, prior to locking cap 100 to tray 300, by simply pushing a front portion of cap 100 down towards tray 300. Continuing, FIG. 5C shows an environmental perspective view of electrical connector system 600 with an electrical line side multi-conductor cable 400 and LED tape light 500 with cap 100 closed on tray 300 in a locked position in accordance with one or more embodiments of the present invention. When cap 100 is closed on tray 300, it may be transitioned into the locked position by pulling cap 100 or cable 400 backwards, engaging the interference fit between the plurality of cap retention features (e.g., 155) and the plurality of tray retention features (e.g., 335). The plurality of pogo-pins 205 are compressed and make contact with the corresponding plurality of tape light electrical contacts (e.g., 505). The cap light cutout portion (e.g., 135) and the PCB light cutout portion (e.g., 235) allow light from one or more LEDs 510 to be transmitted from within the profile without casting shadows.

Advantages of one or more embodiments of the present invention may include one or more of the following:

In one or more embodiments of the present invention, an electrical connector system provides a quick, efficient, and robust electrical line side connection to LED tape lights that has a small footprint, alleviates shadows, and allows for the use of higher density LED tape lights.

In one or more embodiments of the present invention, an electrical connector system uses a simplified hinged cap design. An LED tape light may be attached to a tray mounting surface. The hinged cap closes on the tray and is pulled back into a locking position where a plurality of electrical line side wires are electrically connected to a plurality of pogo-pins. The plurality of pogo-pins are compressed by the closure of the hinged cap with respect to the tray and the pogo-pins provide electrical continuity with a plurality of electrical contact pads of the LED tape light.

In one or more embodiments of the present invention, an electrical connector system the hinged cap design includes a light cutout that exposes one or more LED tape light that would otherwise be covered by a connector system or allows for the use of LED tape lights that otherwise could not be used. The pogo-pins that make contact with the plurality of electrical contact pads of the LED tape light may be disposed on the wings of the substantially U-shaped cutout of the printed circuit board allowing light to be transmitted from behind the point of contact. Advantageously, the light cutout allows for more uniform presentation of light from the LED tape light.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An electrical connector system comprising:

a cap comprising:

a plurality of hinge pins disposed on transverse sides of the cap, a plurality of cap mounting holes that extend through the cap, a cap light cutout portion, and a plurality of cap retention features;

a printed circuit board comprising:

a plurality of printed circuit board mounting holes, a printed circuit board light cutout portion, a plurality of printed circuit board electrical contacts, and a plurality of pogo-pins electrically connected to the corresponding plurality of printed circuit board electrical contacts; and a tray comprising:

a plurality of hinge pin receivers formed in transverse sidewalls of the tray, wherein each hinge pin receiver comprises a first portion separated from a second portion by a pin retention feature, a tray mounting surface, and a plurality of tray retention features.

2. The electrical connector system of claim 1, the cap further comprising:

a printed circuit board retention feature disposed on a bottom side of the cap.

3. The electrical connector system of claim 1, the tray further comprising:

a plurality of shroud connection ports formed in the transverse sidewalls of the tray.

4. The electrical connector system of claim 1, the tray further comprising:

a plurality of tape light alignment features.

5. The electrical connector system of claim 1, further comprising:

a plurality of mounting pins disposed through the plurality of cap mounting holes into the plurality of printed circuit board mounting holes, wherein the mounting pins secure the printed circuit board to a bottom side of the cap.

6. The electrical connector system of claim 1, further comprising:

a plurality of electrical wires that connect to the plurality of electrical contacts of the printed circuit board.

7. The electrical connector system of claim 1, wherein each pin hinge pin travels in the corresponding hinge pin receiver from the first portion to the second portion when the cap transitions from the unlocked state to the locked state.

8. The electrical connector system of claim 1, wherein the plurality of cap retention features form an interference fit with the plurality of tray retention features when the cap is in a locked state.

9. The electrical connector system of claim 1, wherein the plurality of pogo-pins are compressed by contact with a plurality of contact pads of a tape light attached to the tray mounting surface.

10. The electrical connector system of claim 1, wherein the plurality of pogo-pins electrically connect the plurality of electrical contacts of the printed circuit board to a plurality of contact pads of a tape light.

11. The electrical connector system of claim 1, wherein a device side of an LED tape light comprises a plurality of lights and a plurality of contact pads.

12. The electrical connector system of claim 1, wherein a portion of an adhesive side of an LED tape light is attached to the tray mounting surface.

13. The electrical connector system of claim 1, wherein one or more lights of the LED tape lights are exposed by the light cutout portion of the cap.

14. The electrical connector system of claim 1, wherein the printed circuit board comprises a rigid circuit board.

15. The electrical connector system of claim 1, wherein the printed circuit board comprises FR4 material.

16. The electrical connector system of claim 1, wherein the printed circuit board comprises a flexible circuit board.

* * * * *